US010214906B2

(12) United States Patent
Kelly

(10) Patent No.: US 10,214,906 B2
(45) Date of Patent: Feb. 26, 2019

(54) REVERSE BALLASTED ROOF SYSTEM

(71) Applicant: Thomas L. Kelly, Waterbury, CT (US)

(72) Inventor: Thomas L. Kelly, Waterbury, CT (US)

( * ) Notice: Subject to any disclaimer, the term of this patent is extended or adjusted under 35 U.S.C. 154(b) by 546 days.

(21) Appl. No.: 14/791,600

(22) Filed: Jul. 6, 2015

(65) Prior Publication Data

US 2016/0010335 A1 Jan. 14, 2016

Related U.S. Application Data

(60) Provisional application No. 62/022,525, filed on Jul. 9, 2014.

(51) Int. Cl.

| | |
|---|---|
| ***E04D 11/02*** | (2006.01) |
| ***E04D 13/16*** | (2006.01) |
| ***E04D 3/02*** | (2006.01) |
| ***E04D 5/00*** | (2006.01) |
| ***E04D 13/17*** | (2006.01) |
| *E04D 13/14* | (2006.01) |

(52) U.S. Cl.

CPC ..... *E04D 3/02* (2013.01); *E04D 5/00* (2013.01); *E04D 11/02* (2013.01); *E04D 13/1606* (2013.01); *E04D 13/172* (2013.01); *E04D 13/1415* (2013.01)

(58) Field of Classification Search

USPC ..... 52/408, 746.11, 309.9, DIG. 16

See application file for complete search history.

(56) References Cited

U.S. PATENT DOCUMENTS 3,266,206 A * 8/1966 Cosby ..... E04D 11/02 427/186
3,763,605 A * 10/1973 Freeman ..... E04D 7/00 156/71
3,965,633 A * 6/1976 Carroll ..... E04B 7/00 52/309.8
3,979,860 A * 9/1976 Roth ..... E04D 13/1415 52/302.1
4,141,187 A * 2/1979 Graves ..... E04D 7/00 219/213
4,233,353 A * 11/1980 Bondoc ..... C04B 26/12 162/123
4,235,058 A * 11/1980 Patry ..... E04D 11/02 52/408
4,335,546 A * 6/1982 Kelly ..... E04D 13/1415 52/58
4,389,826 A * 6/1983 Kelly ..... E04D 3/3603 52/410
4,441,295 A * 4/1984 Kelly ..... E04D 3/3603 52/309.8

(Continued)

*Primary Examiner* — Joshua J Michener
*Assistant Examiner* — Kyle J. Walraed-Sullivan
(74) *Attorney, Agent, or Firm* — Cantor Colburn LLP

(57) ABSTRACT

A converted reverse ballasted roof system is provided including a structural roof beam. Insulation is positioned upwardly adjacent the structural roof beam, and a first waterproofing membrane is arranged upwardly adjacent the first waterproofing membrane. A weighted cover board is disposed upwardly adjacent the first waterproofing membrane and a second waterproofing membrane is installed upwardly adjacent the weighted cover board. The first water proofing membrane and the second waterproofing membrane substantially seal the weighted cover board.

8 Claims, 5 Drawing Sheets

(56) References Cited

U.S. PATENT DOCUMENTS 4,489,531 A * 12/1984 Nelson ..... E04D 11/02 52/199
4,557,081 A * 12/1985 Kelly ..... E04D 5/14 52/199
4,587,164 A * 5/1986 Freeman ..... E04B 7/22 428/314.4
4,649,686 A * 3/1987 Backenstow ..... E04D 5/143 52/410
4,706,432 A * 11/1987 Fishburn ..... E04D 5/142 277/654
4,719,723 A * 1/1988 Van Wagoner ..... E04D 11/02 52/15
4,736,561 A * 4/1988 Lehr ..... E04D 11/02 52/199
4,783,942 A * 11/1988 Nunley ..... E04D 11/02 52/309.1
4,926,596 A * 5/1990 Yeamans ..... E04D 5/12 52/408
5,027,572 A * 7/1991 Purcell ..... E04B 1/7046 52/309.9
5,067,298 A * 11/1991 Petersen ..... E04D 13/1662 156/324.4
5,088,259 A * 2/1992 Myers ..... E04D 11/02 52/309.8
5,108,831 A * 4/1992 Green ..... B32B 5/26 428/102
5,193,326 A * 3/1993 Sheahan ..... E04D 3/3601 52/698
5,212,927 A * 5/1993 Sheahan ..... G01M 3/02 411/381
5,253,461 A * 10/1993 Janoski ..... E04D 11/02 156/71
5,720,147 A * 2/1998 Wenrick ..... E04B 7/00 52/741.4
5,740,647 A * 4/1998 Kelly ..... E04D 11/02 52/199
5,979,133 A * 11/1999 Funkhouser ..... E04D 5/10 428/353
6,092,344 A * 7/2000 Kelly ..... B32B 3/28 52/410
6,256,957 B1 * 7/2001 Kelly ..... E04D 11/02 52/309.12
6,444,073 B1 * 9/2002 Reeves ..... B32B 5/18 156/211
6,872,673 B2 * 3/2005 MacAulay ..... B29C 44/1228 428/318.4
7,490,444 B2 * 2/2009 Nowack ..... E04C 2/292 428/221
7,610,729 B1 * 11/2009 Ayers, Jr. ..... E04D 13/152 454/260
8,186,117 B2 * 5/2012 Eren ..... E01C 3/06 404/31
2004/0261347 A1 * 12/2004 Hageman ..... E04D 5/10 52/506.01
2005/0153093 A1 * 7/2005 Chang ..... E04D 5/10 428/57
2006/0053718 A1 * 3/2006 Kelly ..... E04D 13/1643 52/409
2007/0193157 A1 * 8/2007 Kelly ..... E04D 13/1643 52/309.8
2007/0261346 A1 * 11/2007 Kelly ..... E04G 21/00 52/408
2008/0026663 A1 * 1/2008 Zhang ..... B32B 11/04 442/398
2008/0227350 A1 * 9/2008 Schroer ..... B32B 33/00 442/181
2009/0064618 A1 * 3/2009 Ben-Daat ..... B32B 5/18 52/408
2009/0100775 A1 * 4/2009 Trial ..... E04D 5/10 52/408
2009/0223155 A1 * 9/2009 Perry ..... E02D 31/00 52/309.1
2011/0000159 A1 * 1/2011 Ben-Daat ..... B32B 5/18 52/309.9
2012/0141768 A1 * 6/2012 Gerace ..... B32B 27/304 428/304.4
2012/0204508 A1 * 8/2012 Kalwara ..... B32B 25/042 52/309.3
2014/0260036 A1 * 9/2014 Freeman ..... E04D 13/1662 52/412
2015/0082725 A1 * 3/2015 Beals ..... E04B 1/665 52/410

* cited by examiner

REVERSE BALLASTED ROOF SYSTEM

CROSS-REFERENCE TO RELATED APPLICATION

This application claims the benefit of U.S. provisional patent application Ser. No. 62/022,525 filed Jul. 9, 2014, the entire contents of which are incorporated herein by reference.

BACKGROUND

Exemplary embodiments of the invention relate to a roof system, and more particularly, to a reverse ballasted roof system.

Roof structures have been made for millennia ranging from simple lean-to thatched arrangements to more modern buildings having multiple layers of roofing materials, fire barriers, vapor barriers, air retarders, rigid roof insulations, cover boards, slipsheets and waterproofing membranes all designed to work together to keep the elements away from occupants of the building. Roof structures continue to be improved because each of the systems currently available has drawbacks and improvements are therefore desirable. Typical problems with roof structures relate to wind uplift resistance, energy efficiency with insulations for heat and cold resistance to maintain internal building temperature, as well as time and effort required to install the roof system.

BRIEF SUMMARY OF THE INVENTION

According to one embodiment of the invention, a converted reverse ballasted roof system is provided including a structural roof beam. Insulation is positioned upwardly adjacent the structural roof beam, and a first waterproofing membrane is arranged upwardly adjacent the first waterproofing membrane. A weighted cover board is disposed upwardly adjacent the first waterproofing membrane and a second waterproofing membrane is installed upwardly adjacent the weighted cover board. The first water proofing membrane and the second waterproofing membrane substantially seal the weighted cover board.

According to another embodiment of the invention, a method of modernizing an existing loose laid ballasted roof system is provided. The loose laid ballasted roof system includes a structural roof beam, insulation upwardly adjacent the structural roof beam, a first waterproofing membrane upwardly adjacent the insulation, and a ballast layer upwardly adjacent the first membrane. The method includes removing the ballast layer and installing a weighted cover board upwardly adjacent the first membrane. A second waterproofing membrane is installed upwardly adjacent the weighted cover board such that the first waterproofing membrane and the second waterproofing membrane form a seal around the weighted cover board.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
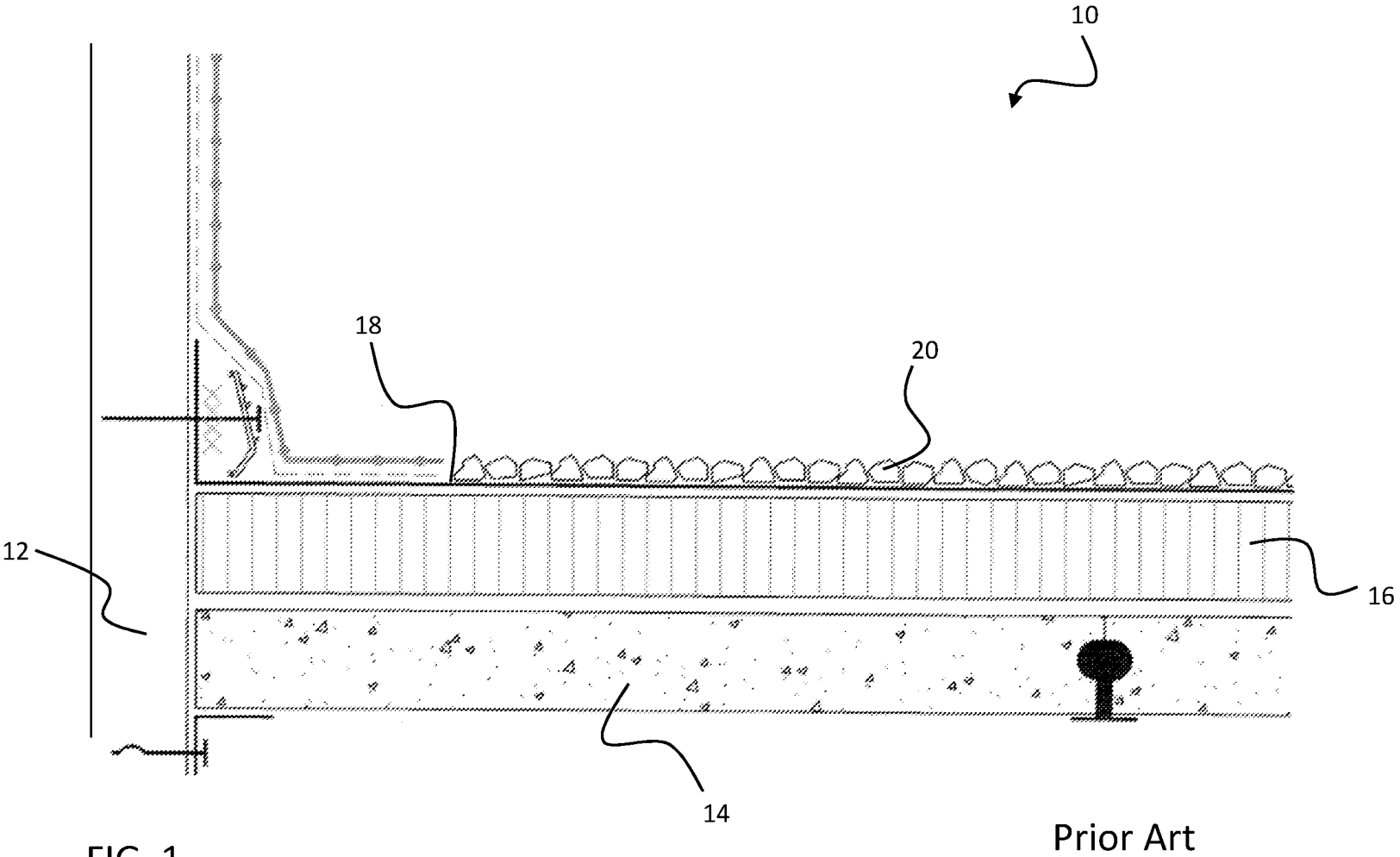
FIG. 1 is a cross-sectional elevation view of a prior art ballasted roof system.

Referring now to FIG. 1, a cross-section of a known prior art "loose laid" ballasted roof system is generally shown at 10. A structural building wall 12 supports one end of a structural roof beam 14, which may include rafters and joists as well as metal, concrete, wood, or the like roof deck panels. An insulation layer 16 is installed over the structural roof beam 14. The insulation layer 16 generally is not fastened or adhered to the adjacent surface of the structural roof beam 14. A waterproofing membrane 18 is loosely installed upwardly adjacent the insulation layer 16. To complete the installation, a weighted layer or ballast 20, such as of rock, gravel, pavers, green roof growing medium, or another similar material is laid over the waterproofing membrane 18 to provide resistance to wind uplift forces and weathering. Depending on the position within the roofing assembly 10, the weight of the ballast 20 may vary. For example, the portion of a conventional ballast 20 arranged directly adjacent the perimeter of the roof system 10 generally has a weight between about thirteen and fifteen lbs/ft$^2$, and the portion of the ballast 20 arranged near the middle or center of the roof system 10 has a reduced weight of between about six and eight lies/ft$^2$.

Figure 2:
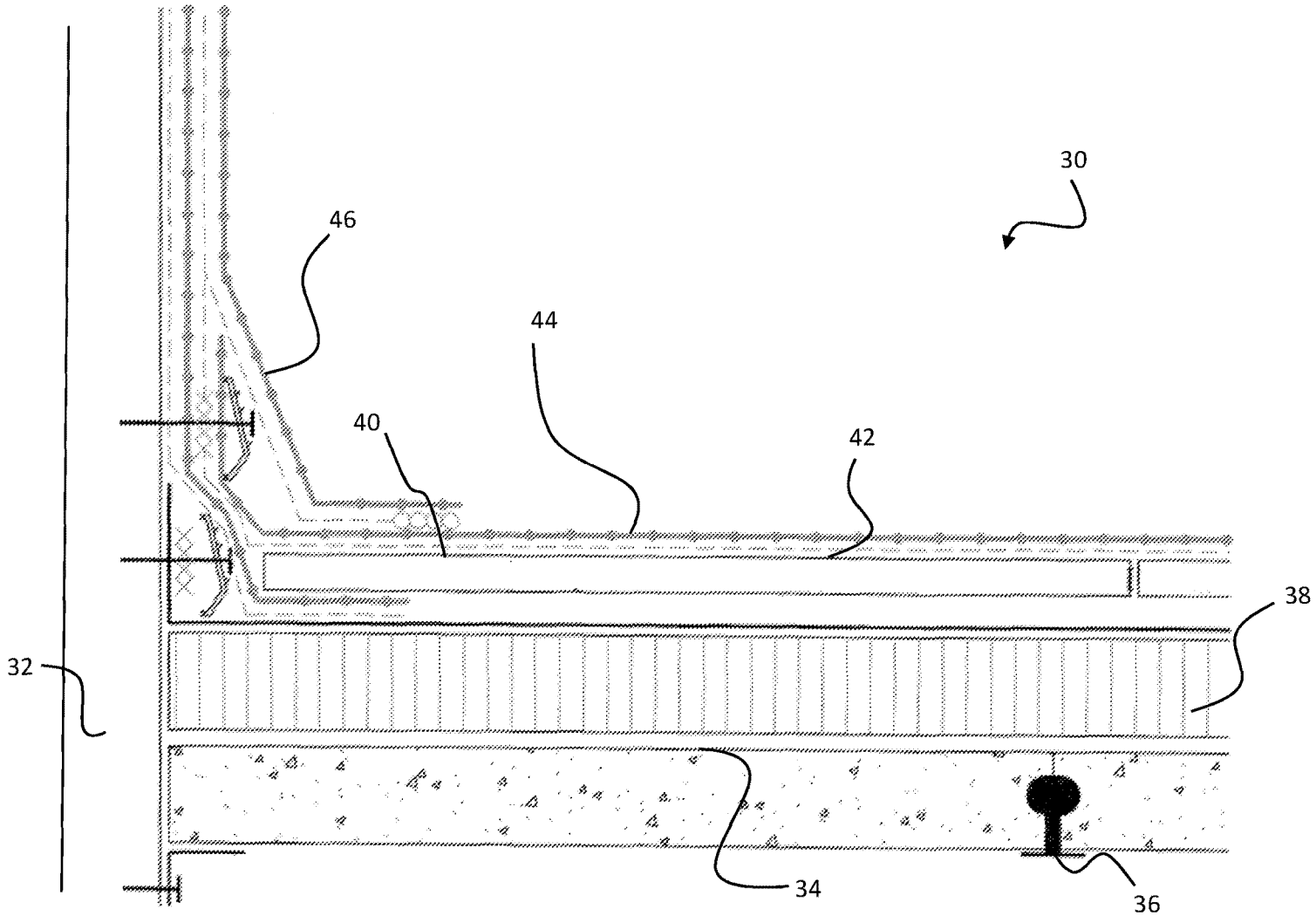
FIG. 2 is a cross-sectional elevation view of the a reverse ballasted roof system according to an embodiment of the invention.

Referring now to FIG. 2, an example of a "reverse ballasted" roof system 30 according to an embodiment of the invention is illustrated. In its simplest form, the roof system 30 includes a structural building wall 32 configured to support one end of a structural roof beam 34. The structural roof beam or deck 34 generally includes structural roof members, such as panels for example, formed from either an air permeable or a non-air permeable material, including, but not limited to, concrete, tectum, gypsum, composite, or the like. In embodiments where the structural roof beam 34 includes a plurality of roof deck panels, fasteners 36 may be arranged at the interface there between to connect the plurality of panels.

Insulation 38 is layered above the upper surface of the structural roof beam 34. The insulation 38 is "loose laid" and therefore is not mechanically fastened to the adjacent structural roof beam 34. The insulation 38 may be formed from polyisocyanurate or expanded or extruded polystyrene as well as other insulating materials common to the roofing industry. Although only a single layer of insulation 38 is illustrated in the FIG., embodiments including additional stacked layers of insulation are within the scope of the invention. In embodiments having more than one layer of insulation, adjacent layers may be locally attached to one another, such as with an adhesive, liquid nail, or spray foam for example.

Positioned upwardly adjacent the one or more layers of insulation 38 is a weighted cover board 40. As a result, the weighted cover board or ballast 40 has a substantially uniform weight across the entire roofing system, regardless of its position relative to a perimeter thereof. The weight of the cover board 40 is intended to prevent movement of the insulation 38 in windy conditions and also to provide a surface on which building personnel may stand and/or work. The cover board 40 generally has a weight of about 4 lbs/ft$^2$ (is there a range, must it be less than weight of conventional ballast?) and comprises one or more of acrylic, concrete, cement, gypsum, oriented strand board, plywood, rigid fiber board, or other solid board material. Specific examples of cover boards 40 include, but are not limited to, an acrylic concrete board, a cement tile board, a cement topped insulation board, DensDeck®, STRUCTODEK®, SECUROCK®, DUROCK®, PermaBase®, WonderBoard®, LIGHTGUARD®, and HEAVYGUARD® for example. The weighted cover board 40 may additionally have properties such that it holds it shape, even while being pulled non-uniformly by attachments to the roof and building structures for example. Because of this tendency to retain its shape, the cover board 40 evenly distributes loads applied thereto to minimize localized stress levels.

In order to waterproof the roofing assembly 30, a waterproofing membrane 44 is positioned over and fully adhered to the upper surface 42 of the weighted cover board 40. The membrane 44 may be made of ethylene propylene diene monomer (EPDM), chlorosulfonated polyethylene (CSPE), polyvinyl chloride (PVC) or other similar roof waterproofing single ply membranes.

A person having ordinary skill in the roofing art will recognize that this application does not disclose the use of adhesive material between the roof deck 34 and the insulation 38 or between the insulation 38 and the weighted cover board 40. Although it might be expected by one of ordinary skill in the art that such would be necessary, in the present system, such is not necessary and therefore the cost in materials and labor to install such materials can be avoided in this roof system.

Although the roof system 30 of FIG. 2 is described in its simplest form, the system 30 may additionally include other layers commonly used in conventional roofing systems. For example, a vapor barrier adhesive (not shown) may be positioned between the structural roof beam 34 and the adjacent insulation 36 to minimize the diffusion of moisture into the building through the roof system 30. In addition, flashing, or thin pieces of generally impervious material (46), may be installed over a portion or all of the waterproofing membrane 44 to form a weather resistant barrier and prevent water from passing into the roof system 30.

Figure 3:
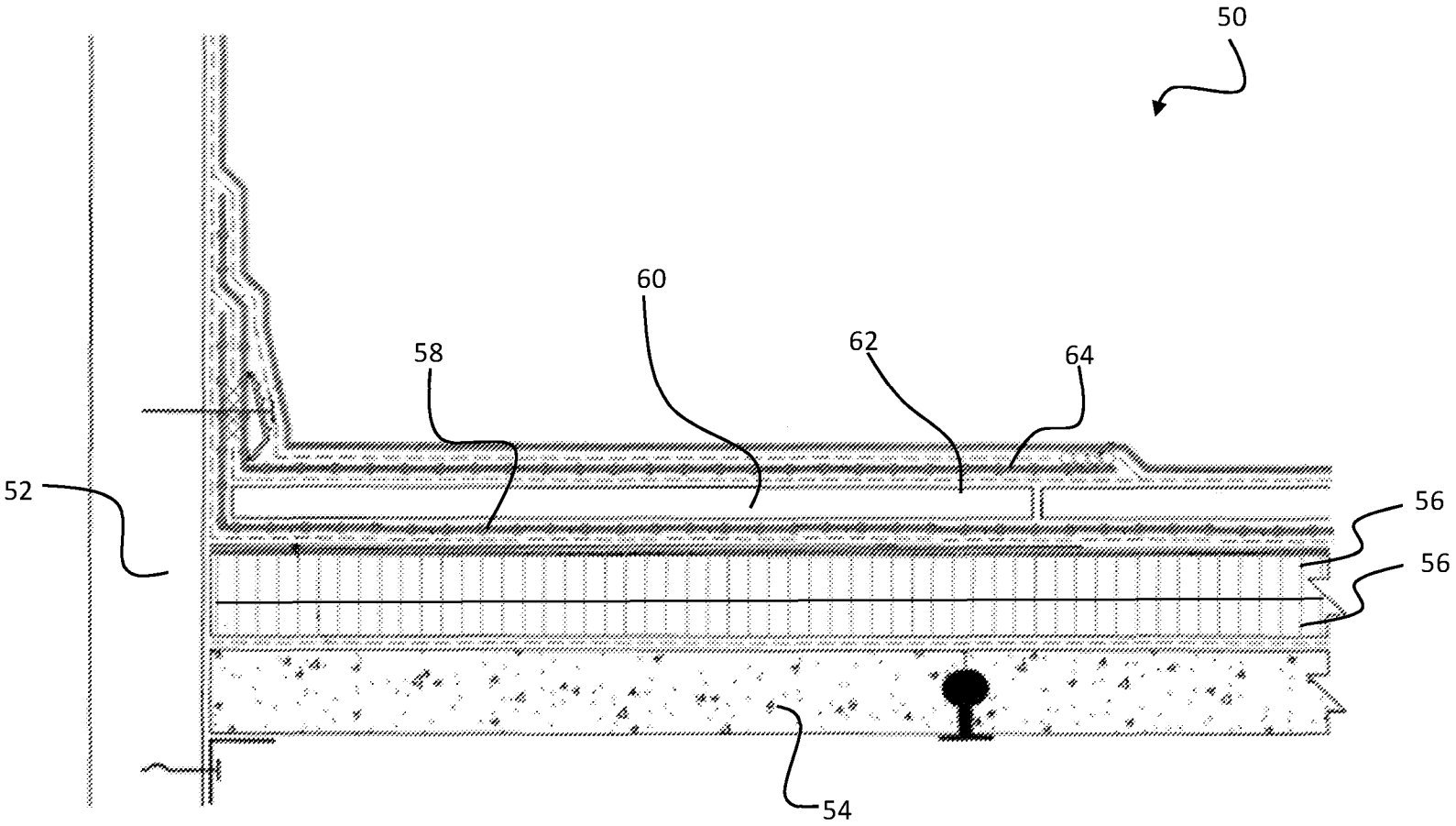
FIG. 3 is a cross-sectional elevation view of a converted reverse ballasted roof system according to an embodiment of the invention.

The "reverse ballasted" roof system 30 may be adapted for use in retrofit or modernization applications of existing loose laid ballasted roof systems 10. An example of a converted reverse ballasted roof assembly 50 is illustrated in FIG. 3. Similar to the other roof assemblies described herein, the converted reverse ballasted roof assembly 50 includes a structural building wall 52, a structural roof beam 54, at least one layer of insulation 56 loosely arranged upwardly adjacent the structural roof beam 54, a first waterproofing membrane 58 loosely positioned over the insulation 56, a layer of weighted cover board 60 disposed over the first waterproofing membrane 58, and a second waterproofing membrane 64 fully adhered to the exposed surface 62 of the weighted cover board 60. The second waterproofing membrane 64 may be substantially identical to the first waterproofing membrane 58 arranged downwardly adjacent the weighted cover board 60, or alternatively, may be different. Together the first membrane 58 and the second membrane 64 are configured to form a seal around the weighted cover board 60. Similar to FIG. 2, the converted reverse ballasted roofing assembly 50 of FIG. 3 is described in its simplest form and may additionally include other known components commonly used in conventional roofing systems.

Figure 4:
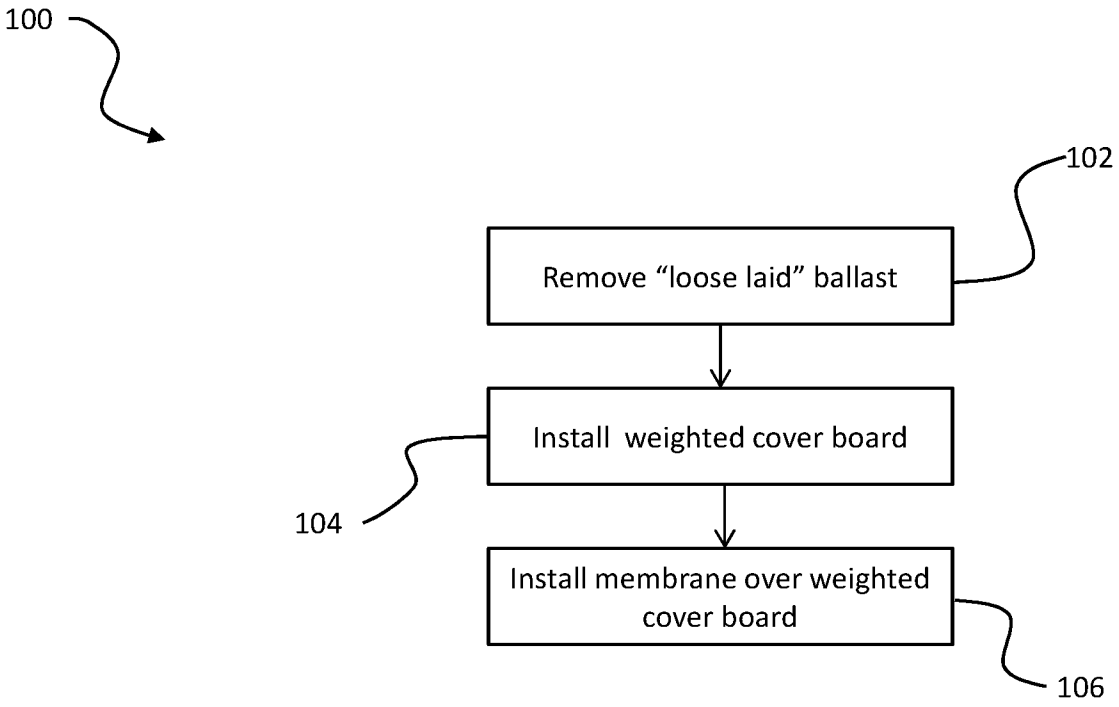
FIG. 4 is a method of converting a ballasted roof system to a reverse ballasted roof assembly according to an embodiment of the invention.

A method 100 of converting an existing loose laid ballasted roof assembly 10 to a modernized "reverse ballasted" roofing assembly 50 is illustrated in FIG. 4. In block 102, the individual components, such as stones for example, that form the original weighted layer or ballast, are removed from the top of the roof assembly 10. In block 104, a weighted cover board is installed uniformly across the roof assembly 10, over the top of the existing waterproofing membrane. The weighted cover board 40 is loose laid over the waterproofing membrane and is not fastened, adhered, or coupled thereto. Another waterproofing membrane is then installed over and fully adhered to the upper surface 42 of the weighted cover board 40 to form a waterproof barrier of the roof system.

Figure 5:
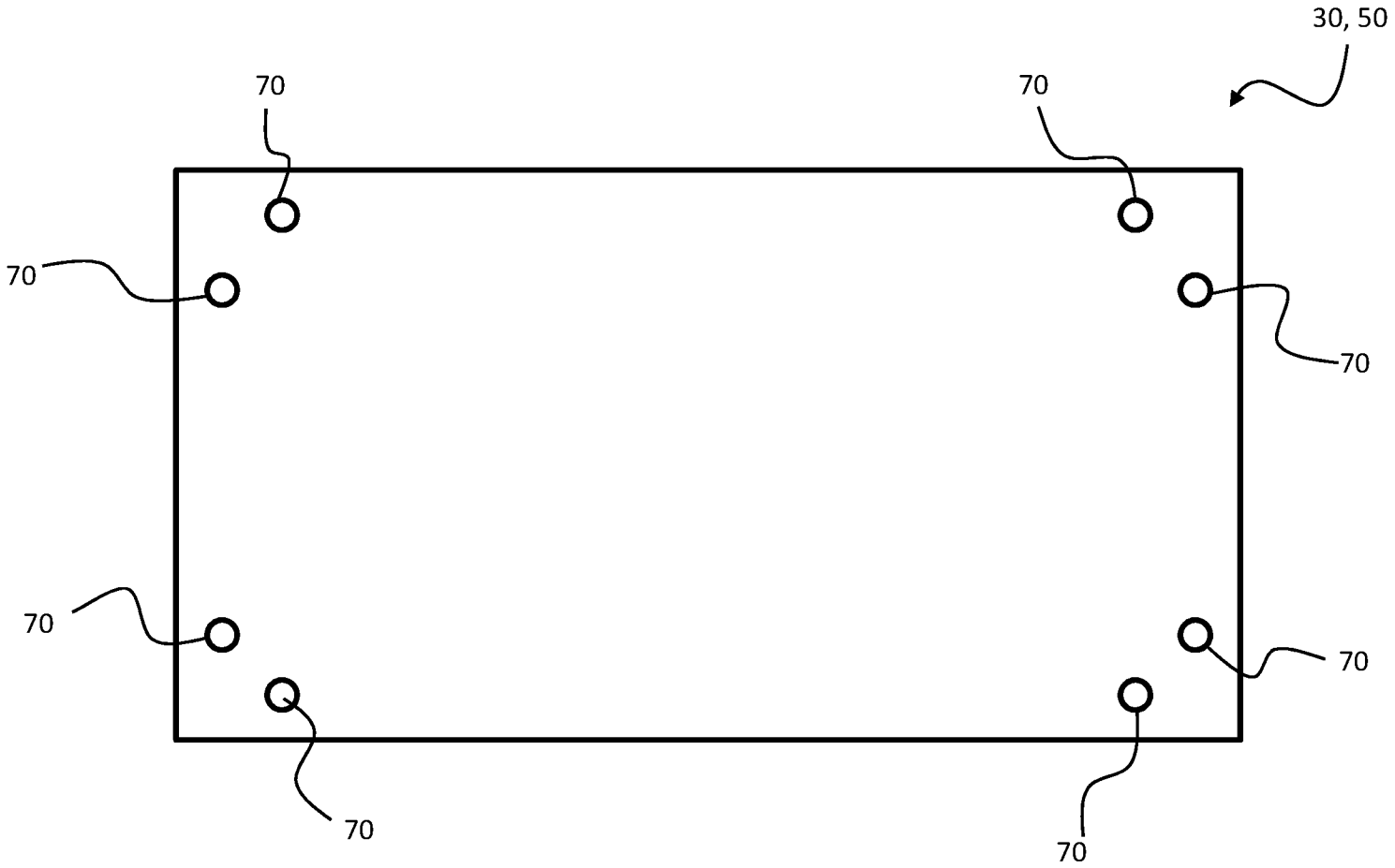
FIG. 5 is a top view of a reverse ballasted roof system having a plurality of equalizer according to an embodiment of the invention.

In embodiments of either the reverse ballasted roof system 30 or the converted reverse ballasted roof system 50 where the structural beam is formed from a non-air permeable material, the roof system 30, 50 may additionally include a plurality of equalizer valves 70 positioned in wind vortex areas, generally about the perimeter of the roof system (FIG. 5). The equalizer valves 70 vent the roof system 30 to prevent the roof from becoming damaged by zones of low pressure above the roof.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A converted reverse ballasted roof system, comprising:

a structural roof beam;

insulation positioned upwardly adjacent said structural roof beam;

a first waterproofing membrane arranged upwardly adjacent said insulation;

a weighted cover board disposed directly adjacent said first waterproofing membrane; and a second waterproofing membrane installed upwardly adjacent said weighted cover board, wherein said first waterproofing membrane and said second waterproofing membrane substantially seal said weighted cover board.

2. The roof system of claim 1, wherein said weighted cover board has a weight of about four lbs/ft$^2$.

3. The roof system of claim 1, wherein said weighted cover board is not mechanically fastened to said first waterproofing membrane.

4. The roof system of claim 1, wherein said second waterproofing membrane is fully adhered to an upper surface of said weighted cover board.

5. The roof system of claim 1, wherein said first waterproofing membrane is not mechanically fastened to said insulation.

6. The roof system of claim 1, wherein said insulation includes a plurality of stacked layers.

7. The roof system of claim 6, wherein said plurality of stacked layers are not mechanically fastened atop one another.

8. The roof system of claim 6, wherein said plurality of stacked layers are locally attached to one another.

* * * * *